United States Patent [19]

Medley

[11] Patent Number: 4,938,445

[45] Date of Patent: Jul. 3, 1990

[54] LOUVER BRACKET ASSEMBLIES

[76] Inventor: Travis D. Medley, 1551 Brenner Way, San Jose, Calif. 95118

[21] Appl. No.: 249,698

[22] Filed: Sep. 27, 1988

[51] Int. Cl.[5] ..... A47G 29/02

[52] U.S. Cl. ..... 248/300; 98/121.1; 256/65

[58] Field of Search ..... 248/300; 52/283, 702; 256/65, 27; 98/121.1, 121.2; 403/27, 189, 232.1

[56] References Cited

U.S. PATENT DOCUMENTS

| | | | |
|---|---|---|---|
| 841,777 | 1/1907 | Hamilton et al. | 52/283 X |
| 1,482,996 | 2/1924 | Jenkins | 98/121.1 X |
| 1,762,223 | 6/1930 | Gross | 98/121.1 X |
| 2,309,717 | 2/1943 | Siebenlist | 98/121.1 |
| 2,789,792 | 4/1957 | Davis | 98/121.2 X |
| 2,990,590 | 7/1961 | Graveley | 403/189 |
| 4,005,942 | 2/1977 | Gilb | 403/189 |
| 4,114,861 | 9/1978 | Long | 248/219.4 X |
| 4,410,294 | 10/1983 | Gilb | 403/27 |
| 4,802,786 | 2/1989 | Yauger | 403/232.1 |

FOREIGN PATENT DOCUMENTS

| | | | |
|---|---|---|---|
| 1961701 | 8/1970 | Fed. Rep. of Germany | 98/121.1 |
| 688306 | 3/1953 | United Kingdom | 98/121.1 |
| 2178159 | 2/1987 | United Kingdom | 98/121.1 |

*Primary Examiner*—J. Franklin Foss

*Attorney, Agent, or Firm*—Jacques M. Dulin

[57] ABSTRACT

Louver bracket assemblies for use in building or extending the height of fences or for providing a sun or privacy screen comprising a side plate having a plurality of spaced flange brackets for receivingly engaging louver boards. The flange brackets are placed on the side plate at a preselected angle of from 15° to 90°, preferably 30°, to the longitudinal axis. The assembly may have an optional short base plate normal to the side plate, which may be bent in either direction along predetermined score lines on the side plate. The side plate preferably has a plurality of slits which may be bent outward to form tabs of various shapes to be used as flanges, or may have an array of holes through which U-shaped flange brackets may be attached at preselected angles. The flanges may have barbs which engage louver boards in the brackets and hold them in position.

17 Claims, 2 Drawing Sheets

LOUVER BRACKET ASSEMBLIES

FIELD:

This invention relates to louver bracket assemblies for use in building or extending the height of fences, or for providing a sun or privacy screen to be hung from rafters. In particular, the louver bracket assemblies of this invention may be attached to the top of wooden fence posts, thus providing an inexpensive means of extending the height of the fence without having to replace the entire fence posts. The bracket assemblies, when used as a pair, allow for louvers to extend across the span formed between spaced-apart brackets.

BACKGROUND AND INFORMATION ON DISCLOSURE STATEMENT:

The use of brackets is common practice in building construction. They are effective for supporting the weight of wood beams, such as stringers, purlins and joists. Many brackets are designed to allow for easy exchange of beams, posts, rails and the like. In addition, using brackets to attach wood beams and joists is easier and less time-consuming since they reduce the need to make mitered joints or other complex joiners at corners. For these reasons, brackets are commonly used during the initial, "framing-out" phase of building construction. The brackets of the present invention are designed primarily for post-construction use, namely for extending the height of fences or otherwise adding to existing structures.

U.S. Pat. No. 4,114,861 (Long, 1978) discloses the use of individual U-shaped horizontal rail-supporting brackets for use in the construction of fences. The Long brackets provide a means for securing fence rails to the fence posts. They comprise a single piece of metal which wraps under a fence rail, being attached to the fence post by means of nails driven through special tubes and channels formed in the brackets.

U.S. Pat. No. 2,608,386 (Hart, 1952) discloses a horizontal cross-bar supporting bracket for round fence posts having parallel flanges and a generally arcuate curved back portion to fit the curve of the round posts. These brackets do not extend the height of a fence.

U.S. Patent No. 841,777 (Hamilton & Gwinnup, 1907) discloses a concrete fence post to which are attached brackets for supporting horizontal fence rails. The rail brackets are metal "pockets" into which the rails are simply dropped in from the top so they can be easily removed. They do not extend the height of the fence nor are they for louvers.

Other U.S. Pat. Nos. such as 4,410,294 (Gilb et al., 1983), 4,005,942 (Gilb, 1977), 3,601,428 (Gilb, 1971) and 2,990,590 (Graveley, 1961) disclose various types of brackets used generally in building construction. The 1983 Gilb patent discloses a connector with an inclined bracket for supporting angled beams, such as rafters, to ridge beams or headers. The 1977 Gilb patent discloses a bracket which hangs down from the top of a structural member. It is attached to the top of a wood member, and hangs down over the edge to form a type of brace, or hanger, for a purlin.

The 1971 Gilb patent discloses a pronged joist hanger for a T-joint between a joist and a header employing integral prongs which protrude from the flanges. The prongs are driven into the wood for temporary holding until load support nails are driven and to provide a minor increase in the holding power of the bracket.

The 1961 Graveley patent discloses an awning rafter saddle tie comprising a metal sheet bent to form two opposing flanges forming the bracket. The brackets are attached to normally vertical walls, and rectangular rafters are fit between the flanges and attached thereto. An angled bridge portion spans between the flanges, and the rafter is rested on the edge of this bridge piece, rather than on a flat plate, so the angle of the rafter can be adjusted.

There is thus a need for louver bracket assemblies which provide an inexpensive means for extending the height of fences and for hanging from rafters to serve as sun or privacy screens.

THE INVENTION

OBJECTS:

It is among the objects of the invention to provide a louver bracket assembly having a series of spaced, parallel angled flanges protecting from a side plate and optionally having a base plate set 90° to the side plate, which in spaced pairs may be attached to the tops of fence posts and extend the height of a fence.

It is among the objects of the invention to provide a louver bracket assembly with a series of spaced, parallel flanges which are either punched out of or attached to the side plate, forming brackets into which boards fit to form louvers for vertical or horizontal fence extensions, or for sun or privacy screens.

It is among the objects of the invention to provide a louver bracket assembly having flanges which include prongs along the inner edge to retain louver boards inserted therein.

It is among the objects of the invention to provide a louver bracket assembly having brackets which are selectably adjustable for louver angle, or the number of which may be increased or decreased.

It is among the objects of the invention to provide a louver bracket assembly which may be hung from rafters to provide screening from the high hot summer sun while allowing warming and light from the lower sun in winter.

Still further and other objects of the invention will be evident from the Summary, Drawings, Detailed Description, Abstract and claims.

SUMMARY:

The present invention relates to means for extending fences and for providing sun or privacy screening when hung from rafters. It comprises a side plate having a series of angled, spaced-apart pairs of flanges for receivingly engaging louver boards. It preferably also has a short base plate set at 90° to, and at one end of the side plate to provide support for the assembly, and to provide a means of structural attachment to the fence top rail. Both the side and base plate preferably have holes through which nails or other fasteners are driven to secure the louver bracket to existing fence posts, fence post extensions, rafters, rails, or tops of fences. The louver brackets are used by spacing them apart, flanges facing each other, with boards of suitable length slipped into the corresponding flange pairs. Typically, for vertical extension of a fence, the side plate is nailed to a fence post extension (e.g., a 4×4 or two 2×4's). However, two assemblies may be butted back-to-back at the side plates where fence post extensions are not available or desired. In this case the base plate is preferably nailed to the top rail of the fence. Optionally, the side plates may be bolted together.

The flanges may be adjusted in the assembly side plate to vary the angle or number of louver boards. The louver angle is preferably in the range of from about 15° to 75° up from the horizontal, and in the most preferred embodiment, the flanges are disposed along the assembly side plate at about a 30° angle up from the horizontal plane, the side plate longitudinal axis being at 90° to the horizontal (i.e., vertical).

The louver-holding flanges may either be punched-out from the assembly side plate or attached thereto. The flanges may have sharp, angled barbs along the inner portions facing the louver boards, to retain the louver boards in place without need for other fastening means.

The assembly of the invention may be secured to sloping rafters, or hung vertically downwardly from rafters, so that the louver board angle forms a sun screen which blocks the hot summer sun while allowing in light and warmth of the lower winter sun.

Transverse scores may be used in the side plate to define a base plate section between the score and a marginal end of the plate, which upon bending in the field forms the base plate. Likewise, in the case of a preformed base plate, aligned notches along opposed side margins may be provided as snap-off or cut-off guides where the base plate is not needed.

BRIEF DESCRIPTION OF THE DRAWINGS:

The invention is illustrated in the following drawings.

DETAILED DESCRIPTION OF THE BEST MODE:

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
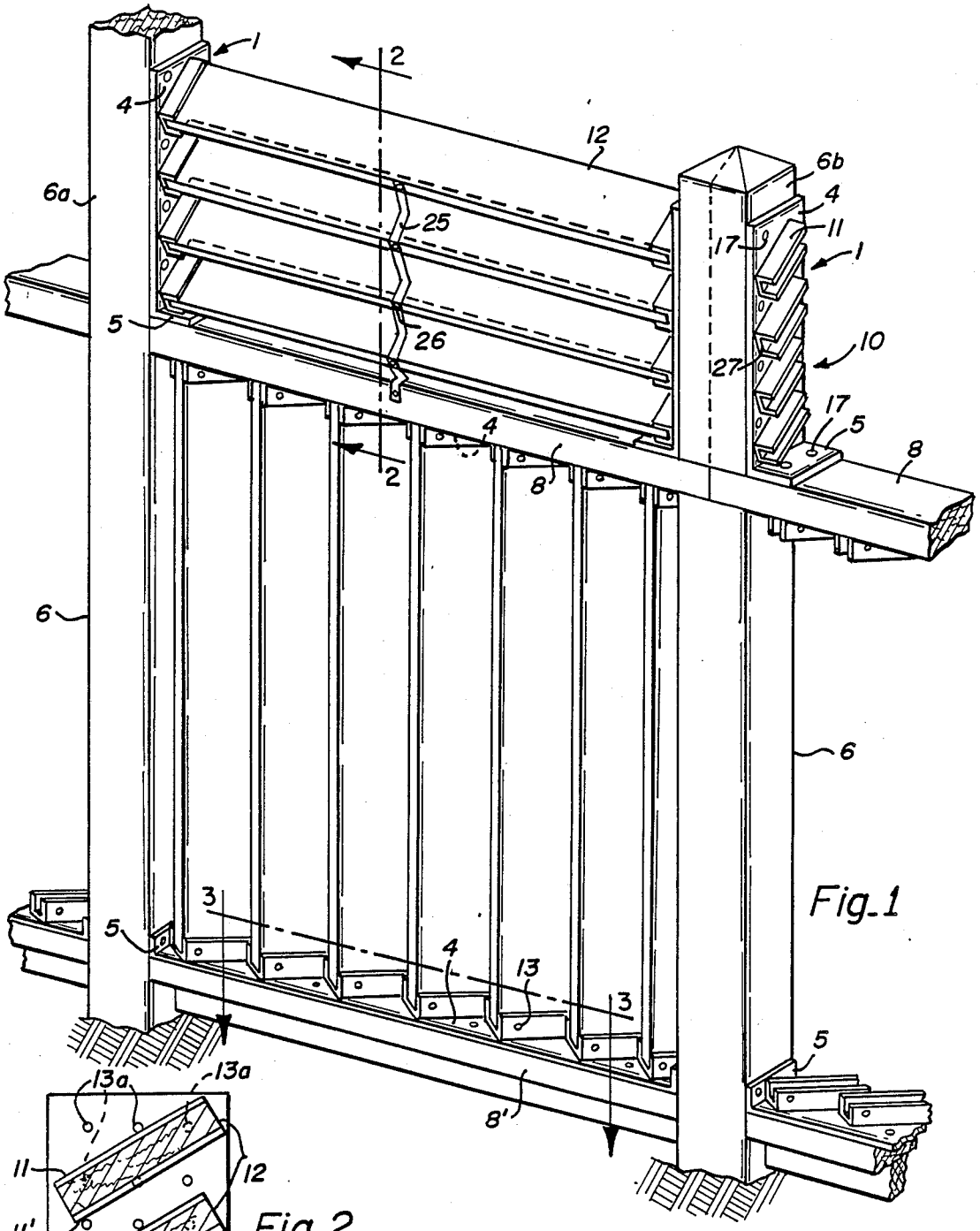
FIG. 1 is a perspective view of the louver brackets of the invention in use on a fence and depicts both horizontal and vertical embodiments of this invention.

FIG. 1 is a perspective view of the louver brackets of the invention in use on a fence. The top section of the drawing shows use of a pair of spaced-apart, opposed louver bracket assemblies 1 oriented vertically, and attached either to a 4×4″ fence post extension *6a* or to a pair of 2×4's *6b* added to the top rail of the fence. By "opposed" is meant that the flanges are facing each other. The louver bracket assemblies 1 additionally or optionally may be attached to the fence by nailing base plate 5 to the top rail 8 by use of nails 17. The base plate 5 is optional, and is used for stability particularly where the extensions *6a* or *6b* are not continuous parts of fence post 6, i.e. are added to the top of the post as in *6b*. Wood boards are positioned between the flange brackets 10 to form louvers 12 which are angled at approximately 30° to the horizontal. The flange brackets 10 are formed by pairs of flanges 11 and may be separate elements made of galvanized sheet metal, anodized aluminum, or other suitable material.

Figure 3:
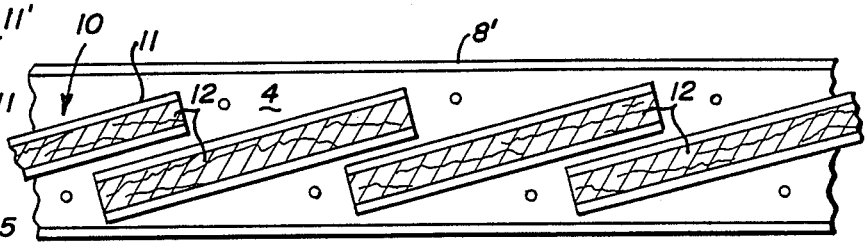
FIG. 3 is a plan view of another embodiment of this invention taken along line 3—3 of FIG. 1 showing use as a fence.
Figure 7:
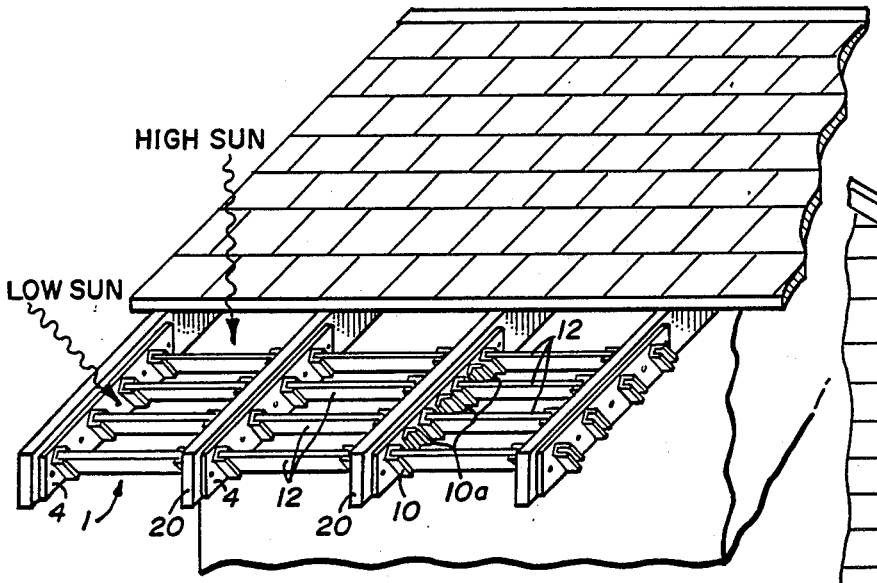
FIG. 7 is a three-quarter perspective view of the louver bracket used on externally extending rafters of a house to permit placement of seasonal sun screen louvers.
Figure 4:
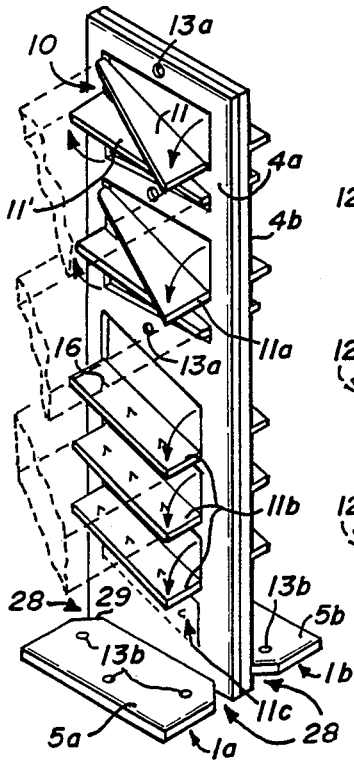
FIG. 4 is a perspective view of another embodiment of this invention in which the bracket flanges are punched out of the base plate.
Figure 5:
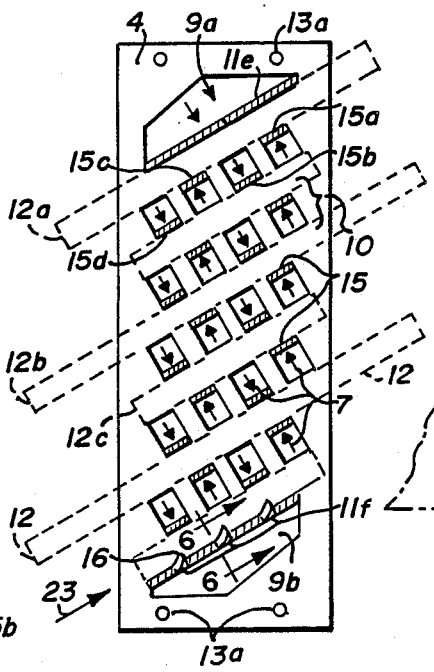
FIG. 5 is a side elevation view of this invention showing variations in punched-out flange configurations, and omitting the base plate for use as horizontal fence brackets or as sun louvers as shown in FIGS. 7 and 8.

The flange brackets 10 have a series of spaced parallel pairs of flanges 11 set at an angle for receivingly engaging louver boards 12. The configuration of the flange brackets 10 on the side plate 4 may be adjustable, or preselected fixed, as to spacing, orientation and number. The flange brackets 10 can be attached to the side plate 4 at various angles, depending on the height of the fence, to provide privacy and screening, and at various spaced intervals as shown in FIGS. 1, 3 and 4. As shown in FIGS. 5 and 7 individual louvers 12 may be removed from brackets *10a* to leave larger gaps for allowing in light, or to reduce the cost of construction.

The lower portion of FIG. 1 and FIG. 3 show an alternate, horizontal orientation of the louver brackets of the invention. The side plate 4 is attached to top and bottom fence rails 8, 8′ with the optional base plate 5 being attached to a fence post 6 for stability. The 30° angle of the brackets provides privacy while reducing the number of louver boards 12 necessary to build a fence.

Figure 2:
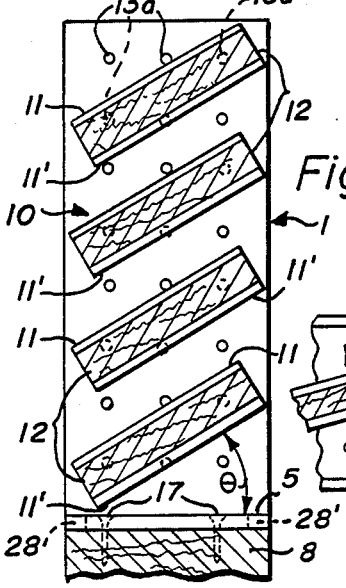
FIG. 2 is a side elevation view of one embodiment of the louver bracket of this invention taken along line 2—2 of FIG. 1 showing use as a vertical fence height extender.

By way of specific example, a fence was extended vertically using louver brackets of the invention as shown in FIGS. 1 and 2. The louver bracket assemblies were made from 18 gauge galvanized metal. The length of the side plate 4 was approximately 13¼″ (measured along the longitudinal axis), with an integral base plate 27 of approximate length of 2½″. Both plates were 3¼″ wide. The paired flange brackets 10 were each formed from individual sheets of the same galvanized metal of approximate length of 3¼″. The spaced flanges 11 extended outwardly approximately 1″, and were spaced 1″ apart. Each louver bracket assembly 1 comprised six paired flange brackets 10 spaced from each other approximately ⅝″ apart at an approximately 30° angle to the longitudinal axis of the side plate 4. Normal 1×4″ wood boards were used as louvers 12. The opposing pairs of louver bracket assemblies 1 were placed approximately eight feet apart. To prevent the boards from sagging, wood spacers or a continuous metal stepped strip (strip 25 in FIG. 1) was used in between the spaced-apart louver bracket assemblies. The strip 25 is secured to the board edges by screws or nails 26.

FIG. 2 shows a side elevation view of the vertical embodiment of the louver bracket assembly 1 along line 2-2 of FIG. 1. The flange bracket 10 consists of a spaced array of pairs of opposing flanges 11, 11′, secured to or formed from the side plate 4. The preferred embodiment is for each pair of flanges 11, 11' to be spaced at an angle $\theta°$ preselected at any desired angle, generally from about 15–75° and preferably 30° relative to the horizontal plane. The side plate 4 may be notched at 28, 28', to facilitate cutting or breaking off the base plate 5 where it is not needed.

As shown in FIGS. 2 and 3 the side plate 4 may have an array of holes 13*a* and 14. Not only are the holes means for attaching the bracket assembly 1 to a fence post, but may also be means for attaching and orienting flange brackets 10 on the side plate 4. Each flange bracket 10 may have a generally centrally located hole 14 through which a screw or rivet may be passed. The bracket may be rotated about this central fastener until optimally oriented on the side plate, at which point the fastener may be tightened and additional fasteners engaged through holes 13*a*. As shown in FIG. 2, both the side plate 4 and the base 27 (see FIG. 1) of the flange bracket 10 may have holes in a spaced array, which when aligned, orient the flange bracket in the preferred angle of 30°, or at any other predetermined desired angle. Optionally, only the flange bracket base 27 may have two holes (a center hole and a hole closer to one end) and the plate 4 has a series of dimples to center the nails. The nails easily pierce the metal when hammered.

FIG. 4 is a perspective view of another embodiment of the invention in which the flange bracket 10 comprises a pair of parallel spaced flanges 11, 11', (upper portion of FIG. 4) which are punched out of the side plates 4*a*, 4*b*. The flanges may be triangular, as at 11*a*, or rectangular as at 11*b*, and of varying number. The flanges may be punched out in the field, and flange 11*c* is shown before being bent into position.

FIG. 4 also shows using the louver bracket assembly 1 for extending the height of fences without attaching it to an existing fence post. Two louver bracket assemblies 1*a* and 1*b* may be butted and attached to each other at the side plates 4*a* and 4*b* by means of screws through holes 13*a*, or by durable adhesive. The combined bracket assembly is then attached to the top of a fence post or rails at the base plates 5*a* and 5*b* by nailing through holes 13*b*. This provides an inexpensive means of extending the height of a fence without having to dig up the existing fence post, or purchase additional lumber for a fence post.

FIG. 4 also illustrates bending the base plate 5 out from the side plate 4. The side plate is a planar sheet having a transverse score 29 spaced medially form one end of the plate. In the field, if an end plate is needed, the worker merely bends it at 90° (or any other needed angle) to the side plate. The side plate may employ a plurality of transverse scores, spaced 2", 4", 6" form one end to provide various sizes of base plates. Likewise the score line can serve as a cut-off guide if the side plate is longer than needed. The score lines may be on both sides of the plate so that the base plate for louver bracket 1*a* may extend to the right (as seen in FIG. 4) rather than to the left.

FIG. 5 is a side elevation view of this invention showing variations in configurations of flanges 11*a*, 11*b*, 11*c*, 11*e*, 11*f* punched out of the side plate 4. A series of tabs 15*a*, 15*b*, 15*c*, 15*d* may be punched out of the side plate 4 to form the flange bracket 10 which receives wood boards to form the louvers 12. The flanges 11*a*, 11*b*, 11*c*, 11*e*, 11*f* may be a variety of shapes and sizes, as seen by cut-outs 9*a* and 9*b* from which flanges 11*e* and 11*f*, respectively are made. Note boards 12, 12*a*, 12*b*, and 12*c* may be different lengths. Arrows 7 show the direction of bending of punched out tabs 15.

It is possible to perforate the side plate 4 with outlines of a plurality of tabs 15, or flanges 11*a*, 11*b*, 11*c*, 11*e*, 11*f* without bending them into position (see unbent flange 11*c* in FIG. 4 and arrow 19 in FIG. 6) so that during construction the worker can easily push out the desired tabs 15 or flanges 11*a*, 11*b*, 11*c*, 11*e*, 11*f* to form paired flange brackets 10 of a desired size or spacing.

The specific dimensions of the bracket assembly will necessarily vary in accordance with three major factors: (1) the material used in construction; (2) the size of the louvers; and (3) the particular use. Thus, if the bracket assembly is to be used to extend the height of a fence, using 8' long 1×4" boards as louvers, and a heavy gauge metal, the flanges will be spaced apart 1" to receivingly engage the boards. The heavier the boards, the more sturdy the material required for the bracket assembly, specifically the individual brackets. Further, the spacer strip 25 (FIG. 1) will be needed to prevent mid-board sag.

Figure 6:
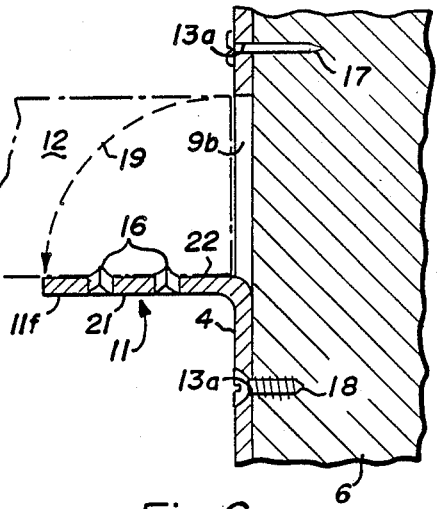
FIG. 6 is a cross section view taken along lines 6—6 of FIG. 5 showing a flange punched out from the side plate and having barbs projecting from the inner face of the flange to retain the louver board.

FIG. 6 is a cross section view of a flange 11*f* of the invention which is punched out from the side plate 4. The inner face of the flange 11 configured with a plurality of inwardfacing sharp, angled barbs 16 which are formed by a series of triangular punches from the outer surface 21 of the flange 11. The inner face is denominated 22. These barbs 16 may be used to secure a louver board 12 positioned in a bracket thus eliminating the need to use other fastening means. The side plate 4 is shown as being attached to the post 6 by either a nail 17 or screw 18, or both.

The louver board 12 is preferably pushed into the bracket from the direction of the arrow 23 in FIG. 5 so the board slides easily over the backs of the barbs 16. The board should be pushed slightly farther up than desired, then pulled backward to set the barb in the wood. Then, under the force of gravity, as a louver 12 tries to slide downward, the barbs 16 catch in the grain of the wood, thus preventing the louver 12 from slipping out of the bracket. The barbs 16 may be used to replace other mechanical means of attachment, or to simply hold the louvers 12 in position until further attachment, such as screws or nails (see 13 in FIG. 1)

FIG. 7 is a three-quarter perspective view of the louver bracket assembly of the invention showing a pair of parallel opposing louver bracket assemblies in use between exterior extending rafters 20 of a building. When thus operatively positioned, the louvers 12 provide a sun or privacy screen. Individual flange brackets 10*a* in the louver bracket assembly 1 may be left unused or not punched out, or the boards removed as the sun shifts with the seasons. The combination of the angle $\theta°$ (FIG. 2) with the slope of the rafters as shown in FIG. 7 results in an effective continuous sun block when the sun is high during the heat of the summer, yet allows light in when the sun is low in the winter season. In the case of sloping rafters, the flange brackets 10 could be set at 90° to the longitudinal axis of the side plate 4. Thus, the overall preselected angle for the flange brackets ranges from about 15° to 90° to the longitudinal axis of the side plate (0+–75° to the horizontal).

Figure 8:
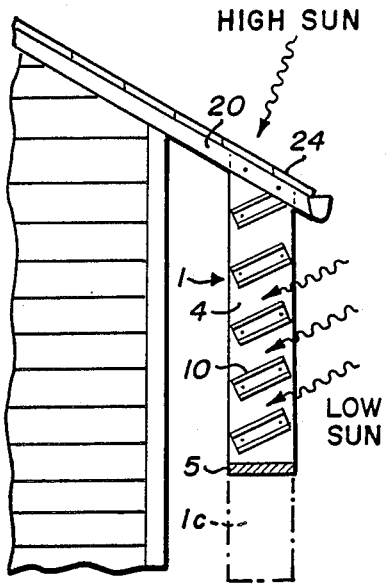
FIG. 8 is a side elevation view of the louver bracket used on externally extending rafters of a house showing use as a sun or privacy screen.

FIG. 8 is a side elevation view of this invention showing the louver bracket assembly 1 suspended vertically down from overhang rafters 20 of a building. The louver bracket assemblies 1 are used by suspending them in parallel, opposing vertical pairs from the rafters 20 of a building, and the upper end 24 may be snipped off to follow the rafter angle or folded over the top of the rafter at an angle for greater support. To provide further vertical extension, additional pairs of louver bracket assemblies 1c may be attached, either at overlapping side plates 4, or at butted base plates 5. Wood boards are then positioned in the paired flange brackets 10 to form louvers. The brackets 10 may be permanently positioned at an angle particular to the location of the building such that the high, hot summer sun is blocked by the louvers, while allowing in the warmth of the low winter sun.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. A louver bracket assembly for retaining louver boards in a spaced array used to extend the height or length of privacy and sun screening units, comprising in operative combination:

(a) a generally rectangular planar plate defined into:
  (i) a first, side plate member having a longitudinal axis and marginal edges;
  (ii) a second, base plate member having marginal edges disposed at one end of said side plate member; and
  (iii) said base member plate is disposed substantially normal to said side plate member in a normal use position;

(b) a plurality of flange brackets for retainingly engaging louver boards comprising pairs of flanges disposed substantially normal to said side plate and in association therewith at a pre-selected angle $\theta$ of from about 15° to about 90° to said longitudinal axis of said side plate;

(c) said flange pairs of each of said flange brackets being spaced apart by a preselected amount to receive louver boards therebetween;

(d) said flange bracket flange pairs being spaced from each other along said longitudinal axis by at least one preselected amount to provide preselected spacing of louver boards retained thereby; and (e) said side plate member and said base plate member includes a plurality of holes disposed to permit securing at least one of said plate members to a structural member by fastening means received therethrough.

2. A louver bracket assembly as in claim 1 wherein:

(a) said planar plate includes at least one score line transverse to said longitudinal axis disposed medially of a first end of said planar plate to define said base plate member as a minor section of said planar plate between said score line and said first end; and (b) said base plate member is formable from said side plate by bending said base plate section at an angle to said side plate along said score line.

3. A louver bracket assembly as in claim 1 wherein:

(a) said side plate includes a plurality of slits defining tab areas in said side plate; and (b) said tab areas are formable into tabs cooperatively disposed to form said flanges.

4. A louver bracket assembly as in claim 2 wherein:

(a) said side plate includes a plurality of slits defining areas in said side plate; and (b) said tab areas are formable into tabs cooperatively disposed to form said flanges.

5. A louver bracket assembly as in claim 1 wherein said flange bracket flange pairs are substantially equally spaced from each other.

6. A louver bracket assembly as in claim 2 wherein said flange bracket flange pairs are substantially equally spaced from each other.

7. A louver bracket assembly as in claim 4 wherein said flange bracket flange pairs are substantially equally spaced from each other.

8. A louver bracket assembly as in claim 1 wherein at least some of said flanges include means for retaining louver boards received in said flange bracket flange pairs.

9. A louver bracket assembly as in claim 8 wherein said retaining means includes slits in said flanges disposed to be formable into barbs to engage at least one surface of said louver board.

10. A louver bracket assembly as in claim 2 wherein at least some of said flanges include means for retaining louver boards received in said flange bracket flange pairs.

11. A louver bracket assembly as in claim 3 wherein at least some of said flanges include means for retaining louver boards received in said flange bracket flange pairs.

12. A louver bracket assembly as in claim 2 which includes at least one relieved portion disposed along a marginal edge of a least one of said plate members adjacent to the juncture of said side plate with said base plate.

13. A louver bracket assembly as in claim 3 which includes at least one relieved portion disposed along a marginal edge of a least one of said plate members adjacent to the juncture of said side plate with said base plate.

14. A louver bracket assembly as in claim 9 which includes at least one relieved portion disposed along a marginal edge of a least one of said plate members adjacent to the juncture of said side plate with said base plate.

15. A louver bracket assembly as in claim 2 wherein:

(a) said side plate includes a plurality of slits defining tab areas in said side plate;

(b) said tab areas are formable into tabs cooperatively disposed to form said flanges;

(c) said flange bracket flange pairs are substantially equally spaced from each other;

(d) at least some of said flanges include slits in said flanges disposed to be formable into barbs to engage at least one surface of said louver board; and (e) a least one relieved portion disposed along a marginal edge of at least one of said plate members adjacent the juncture of said side plate with said base plate.

16. A louver bracket assembly as in claim 4 wherein:

(a) at least some of said flanges include means for retaining louver boards received in said flange brackets.

17. A louver bracket assembly as in claim 16 wherein said retaining means includes slits in said flanges disposed to be formable into barbs to engage at least one surface of said louver board.

* * * * *